US008998659B2

(12) United States Patent
Sato et al.

(10) Patent No.: US 8,998,659 B2
(45) Date of Patent: Apr. 7, 2015

(54) CRIMPING TERMINAL

(71) Applicant: Yazaki Corporation, Tokyo (JP)

(72) Inventors: Kei Sato, Shizuoka (JP); Shinji Kodama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/856,858

(22) Filed: Apr. 4, 2013

(65) Prior Publication Data

US 2013/0231013 A1 Sep. 5, 2013

Related U.S. Application Data

(63) Continuation of application No. PCT/JP2011/072971, filed on Oct. 5, 2011.

(30) Foreign Application Priority Data

Oct. 7, 2010 (JP) ..... 2010-227479

(51) Int. Cl.

| | |
|---|---|
| ***H01R 4/10*** | (2006.01) |
| ***H01R 4/18*** | (2006.01) |
| ***H01R 4/62*** | (2006.01) |
| ***H01R 4/70*** | (2006.01) |

(52) U.S. Cl.

CPC ..... *H01R 4/18* (2013.01); *H01R 4/185* (2013.01); *H01R 4/62* (2013.01); *H01R 4/70* (2013.01)

(58) Field of Classification Search

USPC ..... 439/100, 275, 519–521, 604, 606, 877, 439/878, 936; 174/74 R, 84 C, 84 R, 94 R

See application file for complete search history.

(56) References Cited

U.S. PATENT DOCUMENTS

| | | | | |
|---|---|---|---|---|
| 2,850,711 | A * | 9/1958 | Terlinde | 439/269.2 |
| 5,326,273 | A | 7/1994 | Kamon et al. | |
| 5,567,170 | A * | 10/1996 | Kroeber | 439/186 |
| 6,729,903 | B1 * | 5/2004 | Clark | 439/590 |
| 6,981,897 | B2 * | 1/2006 | Sakatani | 439/606 |
| 7,361,841 | B1 * | 4/2008 | Smolen et al. | 174/138 F |
| 8,449,328 | B2 * | 5/2013 | Ooki | 439/606 |
| 8,480,421 | B2 * | 7/2013 | Yoshioka et al. | 439/275 |
| 8,607,449 | B2 * | 12/2013 | Kitagawa et al. | 29/863 |
| 2009/0229880 | A1 | 9/2009 | Watanabe | |

FOREIGN PATENT DOCUMENTS

| | | | |
|---|---|---|---|
| EP | 1 028 486 | A2 | 8/2000 |
| JP | 4-99364 | U | 8/1992 |
| JP | 10-50377 | A | 2/1998 |
| JP | 2000-231951 | A | 8/2000 |

(Continued)

OTHER PUBLICATIONS

International Search Report for PCT/JP2011/072971 dated Nov. 22, 2011.

Russian Office Action for the related Russian Patent Application No. 2013120521 dated Jul. 11, 2014.

Japanese Office Action for the related Japanese Patent Application No. 2010-227479 dated Aug. 13, 2014.

(Continued)

*Primary Examiner* — Thanh Tam Le

(74) *Attorney, Agent, or Firm* — Kenealy Vaidya LLP

(57) ABSTRACT

A first member including an electric connection portion and a second member including an electric wire connecting portion are joined together. The first member and the second member are made of dissimilar metal materials. Joined portions of the first member and the second member are covered with a resin mold portion.

2 Claims, 5 Drawing Sheets

(56) References Cited

FOREIGN PATENT DOCUMENTS

| | | | |
|---|---|---|---|
| JP | 2002-315130 | A | 10/2002 |
| JP | 2003-297447 | A | 10/2003 |
| JP | 2004-111058 | A | 4/2004 |
| JP | 2004-199934 | A | 7/2004 |
| WO | 2006/106971 | A1 | 10/2006 |

OTHER PUBLICATIONS

Korean Office Action for the related Korean Patent Application No. 10-2013-7008780 dated Sep. 26, 2014.

Korean Office Action for the related Korean Patent Application No. 10-2013-7008780 dated Mar. 17, 2014.

Chinese Office Action for the related Chinese Patent Application No. 201180048499.8 dated Dec. 1, 2014.

* cited by examiner

CRIMPING TERMINAL

CROSS REFERENCE TO RELATED APPLICATION

This application is a continuation of PCT application No. PCT/JP2011/072971, which was filed on Oct. 5, 2011 based on Japanese Patent Application No. 2010-227479 filed on Oct. 7, 2010, the contents of which are incorporated herein by reference. Also, all the references cited herein are incorporated as a whole.

BACKGROUND OF THE INVENTION

1. Technical Field

The present invention relates to a crimping terminal which is mostly used as a connector terminal.

2. Background Art

A typical crimping terminal has a front part having an electric connection portion for connection to a counterpart terminal or the like, and a rear part having an electric wire connecting portion adapted to be crimped and connected to an end portion of an electric wire. The wire connecting portion is usually configured such that a conductor crimping portion is disposed on the front side and a sheath fastening portion is disposed on the rear side with a space provided therebetween.

In this type of crimping terminals, a terminal having two members made of dissimilar metal materials provided separately and then put together is known, examples thereof are described in, for example, JP 10-050377 A and JP 2004-199934 A.

FIGS. 5A and 5B illustrate a configuration of a female side terminal fitting (crimping terminal) described in JP 10-050377 A. The female side terminal fitting includes a terminal body 82, provided as a single piece, having an electric wire connecting portion (a conductor crimping portion 82A and a sheath fastening portion 82B) to which an end portion of an electric wire is fixed and a contact portion 82D operable to contact a counterpart male side terminal fitting, and a terminal fitting auxiliary member 81 made of a metal material having higher elasticity than the terminal body 82, joined to the terminal body 82, and having an elastic contact piece 81D which presses the counterpart male side terminal fitting against the contact portion 82D.

An insert portion 82C which is inserted into a box portion 81A of the terminal fitting auxiliary member 81 is provided at the front of the terminal body 82 (the side in contact with the terminal fitting auxiliary member 81), and the contact portion 82D is provided above the insert portion 82C. The elastic contact piece 81D of the terminal fitting auxiliary member 81 is disposed inside the box portion 81A. After the terminal fitting auxiliary member 81 and the terminal body 82 are assembled, and a fixing piece 85 of the terminal fitting auxiliary member 81 is crimped onto a fixing portion 86 of the terminal body 82, whereby the elastic contact piece 81D and the contact portion 82D face each other, and the male side terminal fitting of the counterpart connector is received between the elastic contact piece 81D and the contact portion 82D.

In this crimping terminal, the terminal fitting auxiliary member 81 having the elastic contact piece 81D is made of a material having higher elasticity than the terminal body 82, whereby it is possible to increase contact pressure against the counterpart male side terminal fitting.

JP 2004-199934 A describes a connector terminal which has a conductor joining portion joined with a conductor of an aluminum electric wire and a terminal connecting portion electrically connectable to a counterpart terminal. In this connector terminal, the conductor joining portion and the terminal connecting portion are integrally formed using an aluminum-based material, an elastic biasing member which elastically biases the counterpart terminal toward the terminal connecting portion when the terminal connecting portion is connected to the counterpart terminal is molded using an iron-based metal material, and the aluminum-based material and the iron-based metal material are connected together such that the molded terminal connecting portion and elastic biasing portion are joined together.

In this terminal, because the conductor joining portion is formed using the aluminum-based material, and the elastic biasing portion is formed using the iron-based metal material, it is possible to increase contact pressure when being connected to the counterpart terminal while avoiding a problem of electric corrosion when being connected to the aluminum electric wire.

On the other hand, with the conventional terminals described in JP 10-050377 A and Patent Document 2, the two members made of dissimilar metal materials are joined together, but the joined portions remain exposed. Thus, when water adheres to this portion, electric corrosion may occur at the joined portions.

SUMMARY OF THE INVENTION

The invention has been made in view of the situation described above, and it is an object thereof to provide a crimping terminal in which locations where electric corrosion may occur are eliminated as much as possible while two members made of dissimilar metal materials are joined together.

In order to achieve the object described above, a crimping terminal according to one or more aspects of the present invention has the following features (1) to (4).

(1) A crimping terminal includes a first member as a front part including an electric connection portion for connection to a counterpart terminal, and a second member as a rear part including an electric wire connecting portion adapted to be crimped and connected to an end portion of an electric wire. The first member and the second member are joined together, the first member and the second member are made of dissimilar metal materials, and joined portions of the first member and the second member are covered with a resin mold portion.

(2) In the crimping terminal having the configuration of (1) described above, a bottom surface of the resin mold portion is located at the same level as a bottom surface of the terminal or above that level.

(3) In the crimping terminal having the configuration of (1) or (2) described above, joining plate portions substantially parallel to the bottom surface of the terminal are provided at a rear end portion of the first member and at a front end portion of the second member respectively, the joining plate portions are joined such that the joining plate portions are placed on top of one another, and the resin mold portion is provided so as to cover at least the joined portions thus joined.

(4) In the crimping terminal having the configuration of (3) described above, at least one of the first member and the second member has a bent portion between the joining plate portion and the electric connection portion or the electric wire connecting portion, the bent portion forms a substantially Z shape such that the joining plate portion is located above the bottom surface of the terminal, and a lower surface of a lower one of the joining plate portion of the first member and the joining plate portion of the second member placed on top of one another is located above the bottom surface of the terminal.

According to the crimping terminal having the configuration of (1) described above, because the joined portions of the first member and the second member made of dissimilar metal materials are covered with the resin mold portion, it is possible to prevent the occurrence of electric corrosion due to water adhesion at the joined portions. Further, because the materials of the first member and the second member can be freely selected regardless of the material of the counterpart member, the same material as the conductor of the electric wire may be selected for the second member including the electric wire connecting portion, and a material which can sufficiently exhibit rigidity or elasticity may be selected for the first member including the electric connection portion, so that it is possible to allow necessary and sufficient mechanical performance as the crimping terminal to be exhibited while avoiding a problem of electric corrosion at the connecting portion to the electric wire.

According to the crimping terminal having the configuration of (2) described above, the bottom surface of the resin mold portion is located at the same level as the bottom surface of the terminal or above that level, whereby the resin does not protrude from the bottom surface of the terminal. Thus, it is possible to bring the bottom surface of the terminal into close contact with, for example, a bottom surface of a cavity of a connector housing, and to set the crimping terminal in the connector housing in a stable posture.

According to the crimping terminal having the configuration of (3) described above, because the joining plate portions provided at the rear end portion of the first member and at the front end portion of the second member respectively are joined such that they are placed on top of one another, it is possible to achieve strong joining and to increase integrity as the crimping terminal.

According to the crimping terminal having the configuration of (4) described above, because the position of the joining portions to be joined can be set above the bottom surface of the terminal, it becomes easy to set the position of the resin mold portion covering the joined portions above the bottom surface of the terminal.

According to one or more aspects of the invention, it is possible to eliminate the possibility of electric corrosion as much as possible while two members made of dissimilar metal materials are joined together.

The invention has been briefly described above. Details of the invention will be more apparent by reading through the embodiments of the invention of described below with reference to the accompanying drawings.

BRIEF DESCRIPTION OF THE DRAWINGS

FIGS. 5A and 5B are configuration diagrams of a conventional terminal, in which FIG. 5A is a perspective view illustrating the entire terminal body and a terminal fitting auxiliary member, and FIG. 5B is a sectional side view of a state where the terminal body and the terminal fitting auxiliary member are put together and integrated.

DETAILED DESCRIPTION OF THE EXEMPLARY EMBODIMENTS

Hereinafter, an embodiment of the invention will be described with reference to the drawings. In the invention, the side of a crimping terminal which is connected to a counterpart terminal is referred to as the front side, and the side which is connected to an electric wire is referred to as the rear side.

Figure 1A:
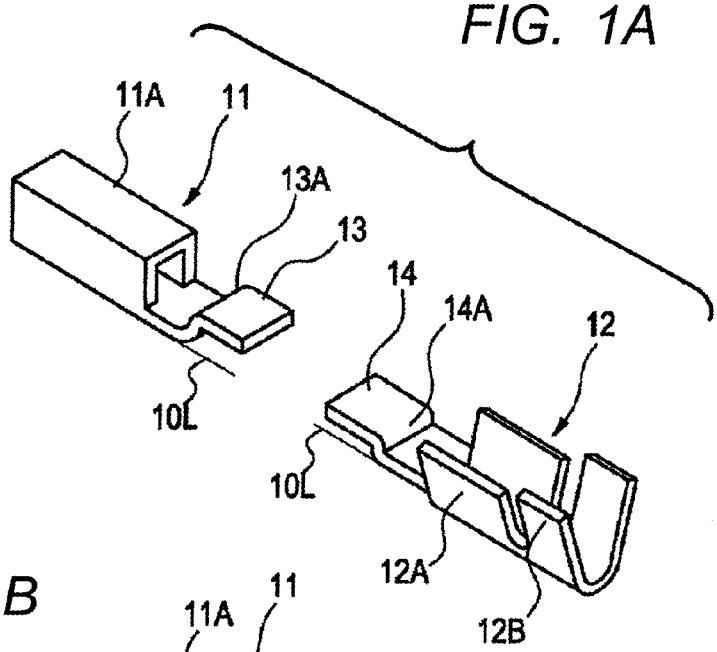
FIGS. 1A to 1C are diagrams illustrating a configuration and a manufacturing process of a crimping terminal according to an embodiment of the present invention.
Figure 1B:
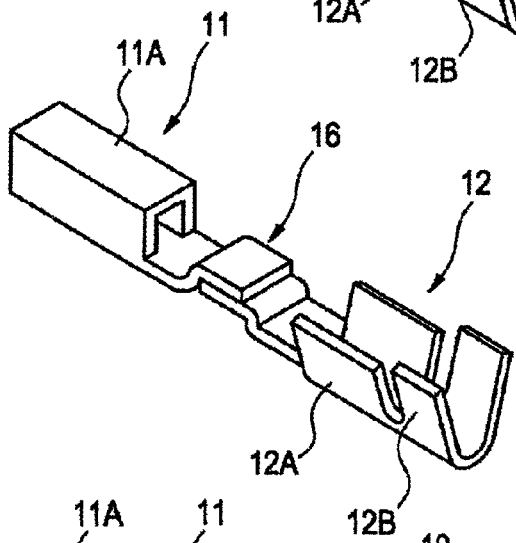
Figure 1C:
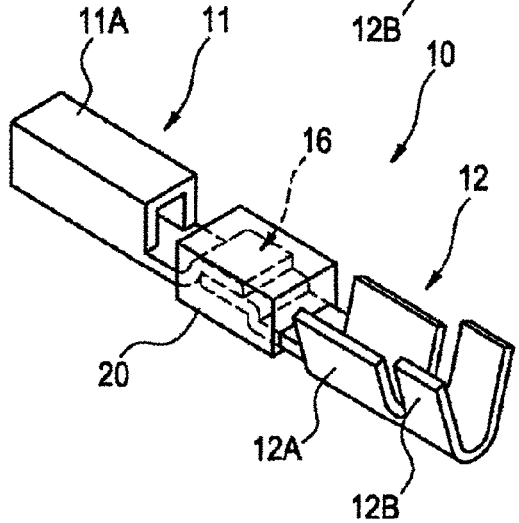
Figure 2A:
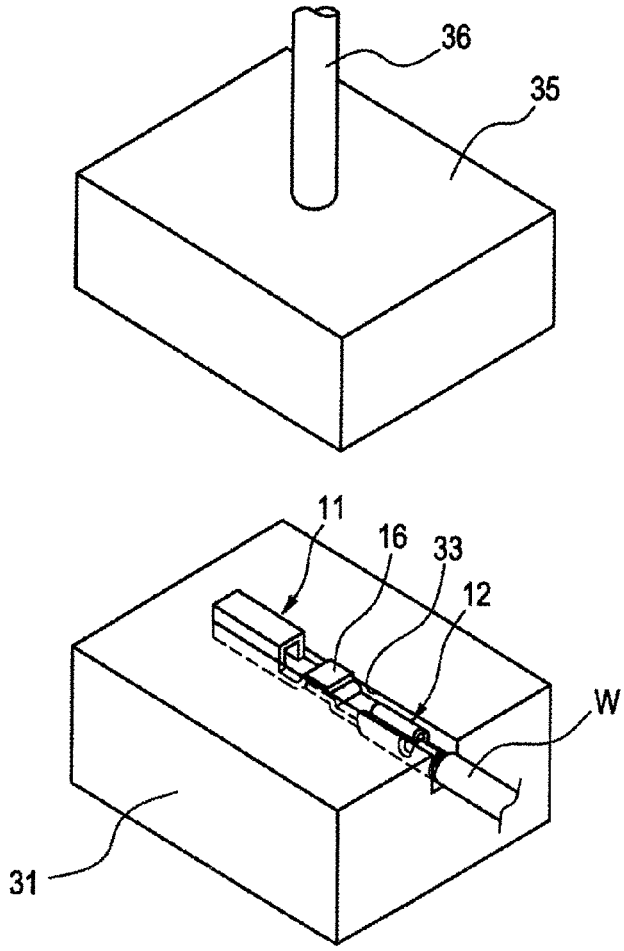
FIG. 2A is an explanatory view of a process of resin molding using a mold at joined portions of a first member and a second member of the crimping terminal.
Figure 2B:
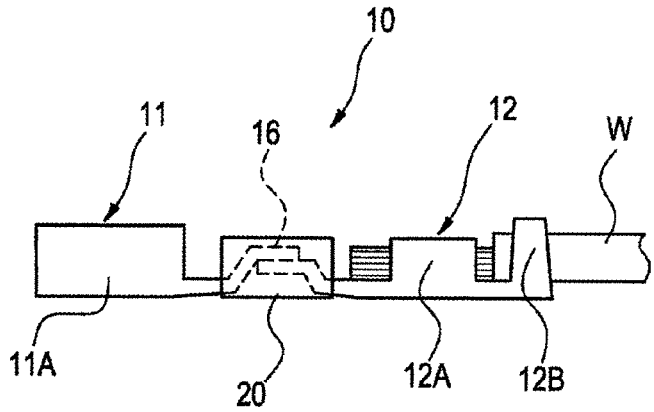
FIG. 2B is a side view of the crimping terminal removed from the mold.

FIGS. 1A to 1C are diagrams showing the configuration and a manufacturing process of a crimping terminal according to an embodiment of the invention. FIG. 2A is an explanatory view of a process of resin molding using a mold at joined portions of a first member and a second member of the crimping terminal, and FIG. 2B is a side view of the crimping terminal removed from the mold.

As shown in FIG. 1C, a crimping terminal 10 of this embodiment is a female terminal for a connector, and includes a front part having a square tubular spring-embedded electric connection portion 11A for connection to a counterpart terminal or the like and a rear part having a conductor crimping portion 12A and a sheath fastening portion 12B, serving as an electric wire connecting portion adapted to be crimped and connected to an end portion of an electric wire. The crimping terminal 10 is configured such that a first member 11 including the electric connection portion 11A and a second member 12 including the electric wire connecting portion (the conductor crimping portion 12A and the sheath fastening portion 12B) are separately provided and joined together, and such that the joined portions 16 are covered with a resin mold portion 20.

The first member 11 and the second member 12 are made of dissimilar metal materials. The second member 12 including the electric wire connecting portion (conductor crimping portion 12A and sheath fastening portion 12B) is made of the same metal material as a conductor of an electric wire to be connected, and the first member 11 including the electric connection portion 11A is made of a metal material having higher rigidity and elasticity than the metal material for the second member 12.

For example, when an electric wire to be connected is an aluminum electric wire, since a conductor serving as a core wire is made of aluminum or an aluminum alloy, the second member 12 is also made of aluminum or an aluminum alloy. In this case, the first member 11 is made of a material in which surface treatment, such as Sn plating or Au plating, is performed with copper or a copper alloy having higher rigidity or elasticity than aluminum or an aluminum alloy as a base material.

When manufacturing the crimping terminal 10, first, as shown in FIG. 1A, joining plate portions 13, 14 which are substantially parallel to a bottom surface 10L of the terminal are respectively provided in a rear end portion of the first member 11 and a front end portion of the second member 12. At this time, the joining plate portion 13 of the first member 11 and the joining plate portion 14 of the second member 12 are provided so as to be positioned at a location above the bottom surface 10L of the terminal via Z-shaped bent portions 13A, 14A, and the joining plate portion 13 of the first member 11 and the joining plate portion 14 of the second member 12 are disposed so as to overlap each other. A lower surface of the joining plate portion 14 on the lower side when the joining plate portion 13 of the first member 11 and the joining plate portion 14 of the second member 12 are placed on top of one another is set so as to be located at the same level as the bottom surface 10L of the terminal or above that level.

In this embodiment, as shown in FIG. 1B, the first member 11 and the second member 12 are moved relatively, and the joining plate portion 13 of the first member 11 is superimposed on the joining plate portion 14 of the second member 12. In this state, the joining plate portions 13, 14 are metal joined together by adhesion, welding, brazing, diffusion joining, or the like.

Next, as shown in FIG. 1C, the resin mold portion 20 is formed so as to cover the joined portions 16, and the crimping terminal 10 with the joined portions 16 unexposed is completed.

When molding the resin mold portion 20, for example, as shown in FIG. 2A, a terminal member in a state where the first member 11 and the second member 12 are joined together is set in a recess 33 of a lower mold 31, and an upper mold 35 is placed thereon. Then, the mold is closed, and molten resin is filled from an inlet 36 of the upper mold 35. It is assumed that a partition wall (not shown) or the like is provided in the upper mold 35 so as to prevent resin from flowing into an extra portion. Resin is filled in this way and hardened, and as shown in FIG. 2B, the crimping terminal 10 in which the joined portions 16 are sealed with the resin mold portion 20 is completed.

Although in the example of FIG. 2, a terminal of an electric wire W is already connected to the electric wire connecting portion (the conductor crimping portion 12A and the sheath fastening portion 12B) of the crimping terminal 10 at the time of resin molding, the terminal of the electric wire W may be connected at any timing, and the terminal of the electric wire W may be connected after resin molding ends and the crimping terminal 10 is removed from the mold. When resin molding is performed in a state where the terminal of the electric wire W is connected to the electric wire connecting portion (conductor crimping portion 12A and sheath fastening portion 12B), resin molding may be performed including the periphery of the conductor exposed portion of the terminal of the electric wire W.

In this case, as shown in FIGS. 3A to 3D, the molded resin mold portion 20 is preferably set such that a bottom surface 20L thereof is located at the same level as the bottom surface 10L of the terminal or above that level. That is, it is preferable to manage the resin mold portion 20 so as not to protrude downward from the bottom surface 10L of the terminal.

In this way, it is possible to bring the bottom surface 10L of the terminal into close contact with, for example, a bottom surface of a cavity of a connector housing, and to set the crimping terminal 10 in the connector housing in a stable posture.

Figure 3A:
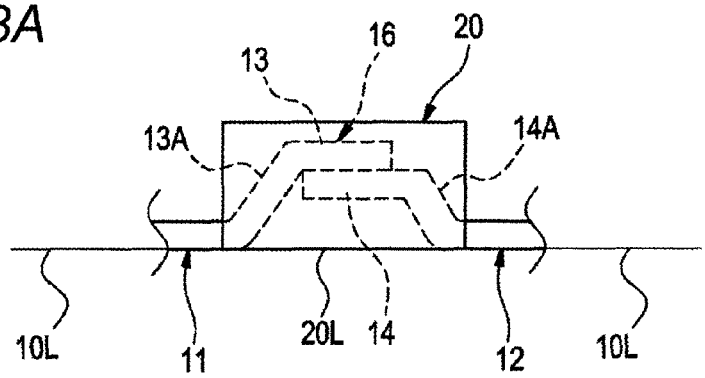
FIGS. 3A to 3D are side views illustrating each example of a configuration of joined portions of the first member and the second member and a configuration of a resin mold portion.
Figure 3B:
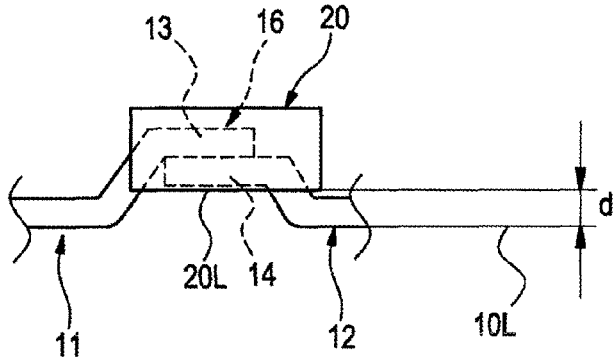

In the example of FIGS. 3A and 3B, the joining plate portions 13, 14 are provided through the bent portions 13A, 14A, whereby the joining plate portions 13, 14 are set to be above the bottom surface 10L of the terminal. Accordingly, it becomes easy to set the bottom surface 20L of the resin mold portion 20 to be above the bottom surface 10L of the terminal. For example, in the case of FIG. 3A, the bottom surface 20L of the resin mold portion 20 is aligned with the bottom surface 10L of the terminal, such that the resin mold portion 20 does not protrude downward from the bottom surface 10L of the terminal. In the case of FIG. 3B, the bottom surface 20L of the resin mold portion 20 is set to be higher than the bottom surface 10L of the terminal by dimension d.

Figure 3C:
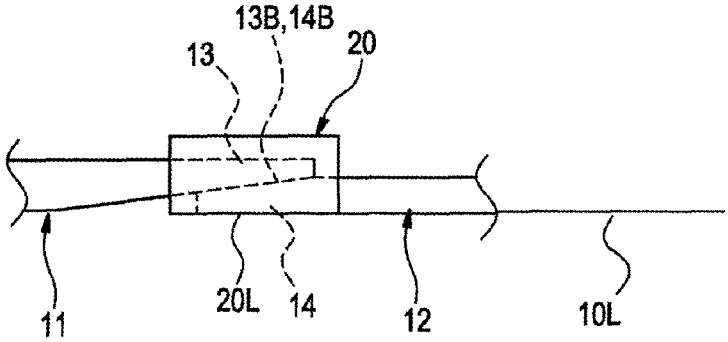
Figure 3D:
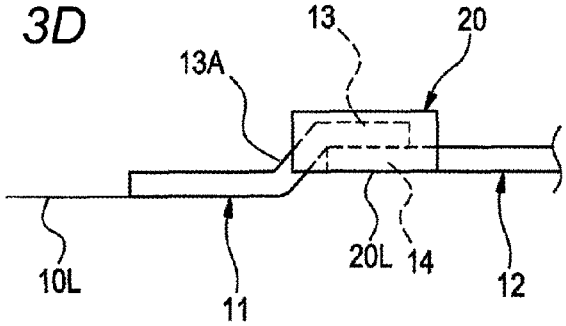

In the example of FIG. 3C, no bent portions are provided, inclined surfaces 13B, 14B are provided as the overlapping surfaces of the joining plate portions 13, 14, joining is made in a state where the inclined surfaces 13B, 14B overlap each other, and the resin mold portion 20 is provided so as to cover the joined portions. In the example of FIG. 3C, the bottom surface 20L of the resin mold portion 20 is substantially flush with the bottom surface 10L of the terminal. In the example of FIG. 3C, the resin mold portion 20 is provided so as to cover the end portions of the joining plate portions 13, 14 and to project only in a width direction intersecting a longitudinal direction of the crimping terminal 10. In the example of FIG. 3D, the bent portion 13A is provided only in the base portion of the joining plate portion 13 on the first member 11 side, and the resin mold portion 20 is provided so as to cover the joined portions. In these cases, the bottom surface 20L of the resin mold portion 20 is set to be above the bottom surface 10L of the terminal, whereby the resin mold portion 20 does not protrude from the bottom surface 10L of the terminal.

As described above, according to the crimping terminal 10, since the joined portions 16 of the first member 11 and the second member 12 made of dissimilar metal materials are covered with the resin mold portion 20, it is possible to prevent the occurrence of electric corrosion due to water adhesion to the joined portions 16. Since the materials of the first member 11 and the second member 12 can be freely selected regardless of the material of the counterpart member, the same material as the conductor of the electric wire W is selected for the second member 12 including the electric wire connecting portion (the conductor crimping portion 12A and the sheath fastening portion 12B), and a material which can sufficiently exhibit rigidity or elasticity is selected for the first member 11 including the electric connection portion 11A, whereby it is possible to allow necessary and sufficient mechanical performance to be exhibited as the terminal while avoiding a problem of electric corrosion at the connecting portion to the electric wire W.

For example, when an electric wire to be connected is an aluminum electric wire, if the second member 12 including the electric wire connecting portion (conductor crimping portion 12A and sheath fastening portion 12B) is made of aluminum or an aluminum alloy, and the first member 11 including the electric connection portion 11A is made of a material in which copper or a copper alloy having higher rigidity or elasticity than aluminum or an aluminum alloy is used as a base material, it is possible to eliminate the possibility of electric corrosion in crimped portions of the conductor of the electric wire and the electric wire connecting portion (conductor crimping portion 12A and sheath fastening portion 12B), and to secure necessary and sufficient rigidity or elasticity of the electric connection portion 11A which is connected to the counterpart terminal or the like.

Since the joining plate portion 13 provided in the rear end portion of the first member 11 and the joining plate portion 14 provided in the front end portion of the second member 12 are metal-joined such that they are placed on top of one another, it is possible to achieve solid joining and to increase integrity as the crimping terminal 10.

When the joining plate portions 13, 14 provided through the bent portions 13A, 14A are joined together such that they are placed on top of one another, since the joined portions 16 can be set above the bottom surface 10L of the terminal, it becomes easy to set the bottom surface 20L of the resin mold portion 20 covering the joined portions 16 above the bottom surface 10L of the terminal.

The invention is not limited to the foregoing embodiment, and modifications, improvement, and the like may be appropriately made. The material, shape, dimension, number, arrangement place, and the like of each constituent element in the foregoing embodiment can be arbitrarily set insofar as the invention can be attained, and are not limited to the foregoing embodiment.

Figure 4:
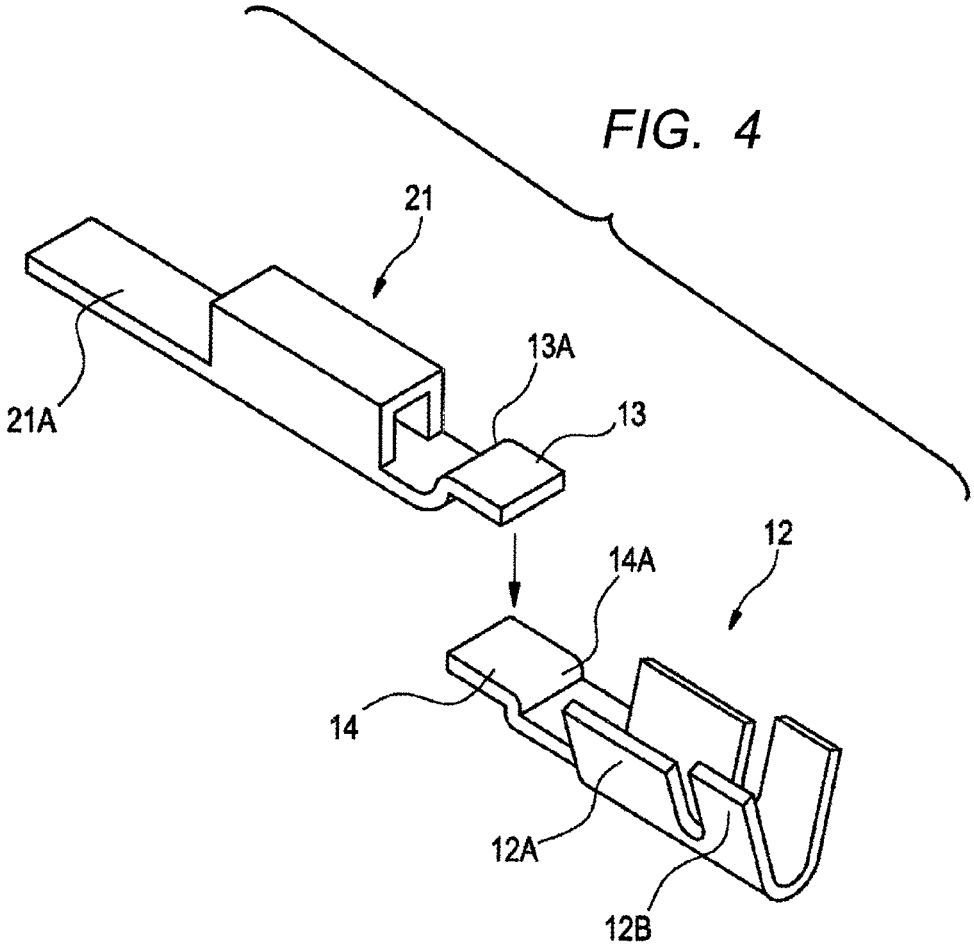
FIG. 4 is an explanatory view of a crimping terminal according to another embodiment of the invention.
Figure 5A:
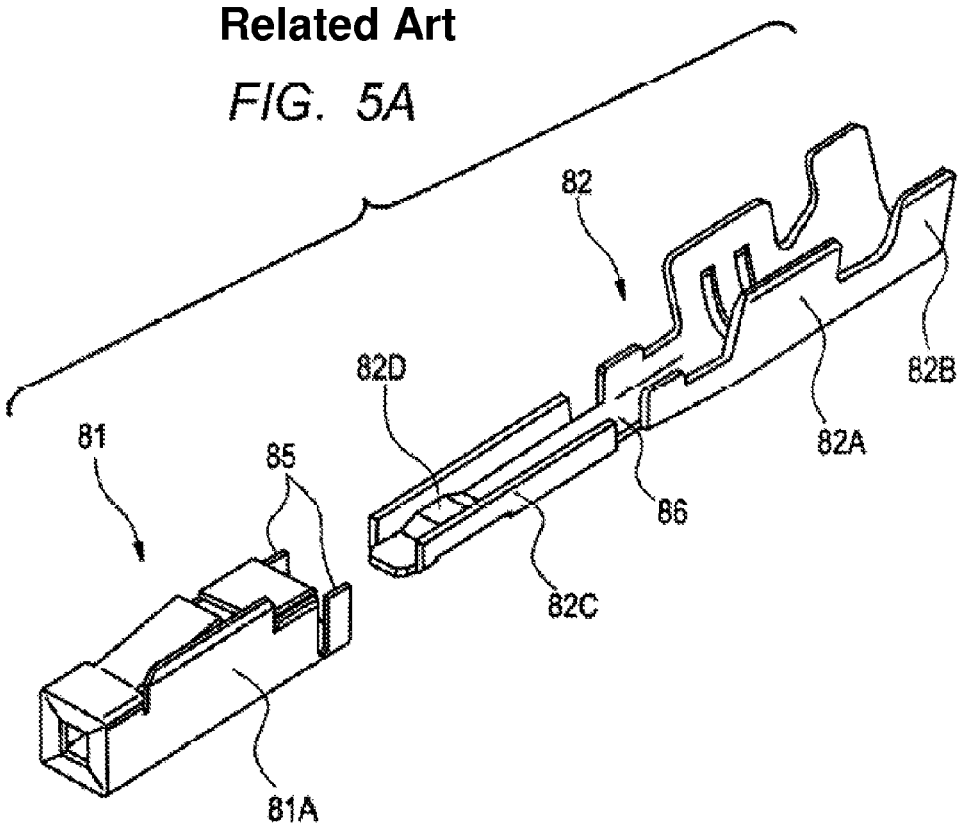
Related Art FIG. 5A
Figure 5B:
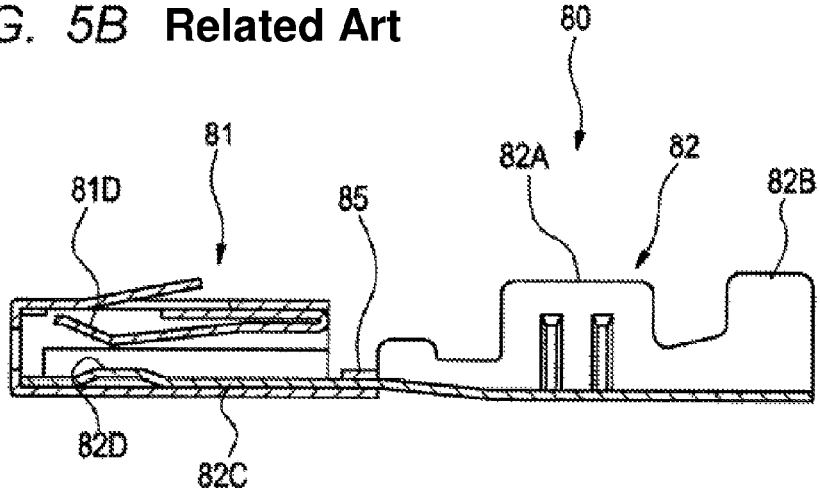
FIG. 5B Related Art

For example, although in the foregoing embodiment, a case where the female crimping terminal is provided has been described, as shown in FIG. 4, a first member 21 having a male terminal-type electric connection portion 21A may be combined with a second member 12 having an electric wire connecting portion (a conductor crimping portion 12A and a sheath fastening portion 12B), and a joined portion at which a joining plate portion 13 provided in the rear end portion of the first member 21 and a joining plate portion 14 provided at the tip of the second member 12 are joined may be resin-molded, whereby a male crimping terminal may be formed.

While the present invention has been described in detail with reference to certain embodiments thereof, it will be apparent to those skilled in the art that various changes and modifications may be made therein without departing from the spirit and scope of the invention.

What is claimed is:

1. A crimping terminal comprising:

a first member as a front part including an electric connection portion for connection to a counterpart terminal;

a second member as a rear part including an electric wire connecting portion adapted to be crimped and connected to an end portion of an electric wire, the first member and the second member being joined together, the first member and the second member being made of dissimilar metal materials;

a resin mold portion that covers joined portions of the first member and the second member, a bottom surface of the resin mold portion being located at a same level or above a level of a bottom surface of the crimping terminal; and joining plate portions substantially parallel to the bottom surface of the terminal are provided at a rear end portion of the first member and at a front end portion of the second member respectively, the joining plate portions are joined such that the joining plate portions are placed on top of one another, and the resin mold portion is provided so as to cover at least the joined portions thus joined.

2. The crimping terminal according to claim 1, wherein at least one of the first member and the second member comprises a bent portion between the joining plate portion and the electric connection portion or the electric wire connecting portion, the bent portion forms a substantially Z shape such that the joining plate portion is located above the bottom surface of the terminal, and a lower surface of a lower one of the joining plate portion of the first member and the joining plate portion of the second member placed on top of one another is located above the bottom surface of the terminal.

* * * * *